US007349660B2

(12) United States Patent
Domoto et al.

(10) Patent No.: US 7,349,660 B2
(45) Date of Patent: Mar. 25, 2008

(54) LOW MASS FUSER APPARATUS WITH SUBSTANTIALLY UNIFORM AXIAL TEMPERATURE DISTRIBUTION

(75) Inventors: Gerald A. Domoto, Briarcliff Manor, NY (US); Nicholas P. Kladias, Flushing, NY (US); Kenneth R. Rasch, Fairport, NY (US); James A. Herley, Chesapeake, VA (US)

(73) Assignee: Xerox Corporation, Stamford, CT (US)

( * ) Notice: Subject to any disclaimer, the term of this patent is extended or adjusted under 35 U.S.C. 154(b) by 220 days.

(21) Appl. No.: 11/167,154

(22) Filed: Jun. 28, 2005

(65) Prior Publication Data

US 2006/0291919 A1 Dec. 28, 2006

(51) Int. Cl.
*G03G 15/20* (2006.01)

(52) U.S. Cl. ..... 399/328; 219/216; 399/330; 430/124.1

(58) Field of Classification Search ..... 399/328, 399/329, 330, 333, 338; 219/216, 469; 118/60; 347/156; 430/124, 124.1
See application file for complete search history.

(56) References Cited

U.S. PATENT DOCUMENTS 6,252,937 B1 * 6/2001 Snyder ..... 378/141
6,445,902 B1 * 9/2002 Hirst et al. ..... 399/328
2001/0024485 A1 * 9/2001 Rogers ..... 378/140
2002/0141795 A1 * 10/2002 Hirst et al. ..... 399/328
2004/0042826 A1 * 3/2004 Cho et al. ..... 399/328
2004/0131400 A1 * 7/2004 Cho et al. ..... 399/328
2004/0141778 A1 * 7/2004 Kim et al. ..... 399/328
2004/0228110 A1 * 11/2004 Hsieh et al. ..... 362/31
2006/0093412 A1 * 5/2006 Herley et al. ..... 399/328
2006/0101831 A1 * 5/2006 Storm et al. ..... 62/3.7

FOREIGN PATENT DOCUMENTS

JP 07-028351 A * 1/1995
JP 2002-357981 A * 12/2002

* cited by examiner

*Primary Examiner*—Sophia S. Chen
(74) *Attorney, Agent, or Firm*—Oliff & Berridge, PLC

(57) ABSTRACT

An energy transfer device may include a fuser roll, a pressure roll, the pressure roller and the fuser roll being part of a marking system, and a heat pipe, the heat pipe being in contact with at least one of the fuser roll and the pressure roll. A method of using an energy transfer device that includes a fuser roll, a pressure roll, the pressure roll and the fuser roll being part of a marking system, and a heat pipe may include contacting the heat pipe with at least one of the fuser roll and the pressure roll, absorbing heat from a relatively hot region of the at least one of the fuser roll and the pressure roll using a working fluid, and dissipating the absorbed heat by evaporating the working fluid.

15 Claims, 5 Drawing Sheets

LOW MASS FUSER APPARATUS WITH SUBSTANTIALLY UNIFORM AXIAL TEMPERATURE DISTRIBUTION

BACKGROUND

Maintaining roll temperature uniformity in fuser roll systems has long been a problem when varying media sizes. Using a heat pipe as a fuser roll is a known technique to solve such temperature uniformity issues. Problems arise though in the complexity in the design of such heat pipe fuser rolls, because heat pipes are closed systems, and applying heat internally is difficult. Applying heat at one end of the fuser roll to simplify the geometry of the subsystem is also commonly done. By applying heat at one end of the system, incident heat flux at that one end is increased. In low mass, "instant-on" or rapid warm-up fuser roll systems, the low mass of the heat conductive fuser rolls increases the heat differentiation much more rapidly and creates a greater thermal difference than in conventional fusing systems. In an instant-on system, it is generally preferable to use a heat pipe with a low volume of fluid, such as water or water-alcohol in order to more rapidly exchange heat from the high temperature areas to the colder regions of the fusing system rolls. Some heat pipe systems incorporate a fiber wicking device to sustain the fluid in the heat pipe. In this minimal fluid configuration, there is a potential for dry-out of the heat pipe evaporator. Means to pump fluids using more complex interior geometries are also well known and used to prevent evaporator dry-out.

Low energy usage requirements in a fuser roll/pressure roll system may be met by minimizing the thermal mass of the fuser roll. Temperature uniformity may be met by heating element profile and design. Usually, these systems are optimized around the media size and weight most used in the market place. However, the need still exists to handle various media widths and substrate thicknesses, which gives rise to temperature non-uniformity along the fuser roll axis. Another factor that contributes to temperature non-uniformity is conductive and convective heat losses from the heating lamps and the fuser roll, for example, to the bearings and supporting framework.

Axial temperature non-uniformity is depicted in FIG. 1, in which the temperature of the fuser roll surface is plotted against the axial position for a 200 copy run of both short-edge feed and long-edge feed 8.5"×11" paper. FIG. 1 describes the relative temperatures along a longitudinal axis of a fuser roll in various configurations as described. Higher temperatures to the right of the graph represent low mass, "instant-on" and rapid warm-up fusing systems as they exist currently exhibiting the temperature gradient within and outside the paper path for various sized media. Other temperature profiles exhibit the effectiveness of the present invention on temperature gradients and achievement of subsequent relative temperature uniformity. In FIG. 1, the temperature of the fuser roll outside the short edge feed paper path is higher than the temperature of the fuser roll inside the paper path by about 76° C. To address this problem, usually a system of two or more heating lamps with associated sensors and controllers is used. FIG. 2 illustrates the axial power distribution, and the ability to achieve relative temperature uniformity by employing a two heat lamp system within a fuser roll in a static state without the influence of heat loss via heat conduction to the passing media substrate. FIGS. 1 and 2 show that such a system with optimized distributed heating lamp profiles may provide a desired temperature uniformity by selectively turning lamps off and on depending on the size and weight of media used.

SUMMARY

However, a two-lamp configuration used to compensate for the temperature gradients involves complex hardware and requires monitoring of the fuser roll temperature at two locations, as well as two temperature feedback systems and two sets of safety control components. The use of a heat pipe system reduces the number of heating elements and control devices, and enables better reliability.

Moreover, because most printing systems are monitored for temperature at a single point on the surface of the fuser roll or of the pressure roll, and the system may be unable to compensate for temperature non-uniformity, exemplary embodiments of a heat pipe in a fusing system eliminate the temperature non-uniformity and may provide temperature stability throughout copy runs. This phenomenon may also be useful for "stand-by" modes where the temperature of the fuser is maintained at a constant temperature with no heat loss to copy substrates.

Various exemplary systems may provide an energy transfer device, including a fuser roll, a pressure roll, the pressure roll and the fuser roll being part of a marking system, and a heat pipe, the heat pipe being in contact with at least one of the fuser roll and the pressure roll.

Various exemplary methods of using an energy transfer device that comprises a fuser roll, a pressure roll, the pressure roll and the fuser roll being part of a marking system, and a heat pipe, may include: (i) the fuser roll or the pressure roll being in contact with a heat pipe, (ii) absorbing heat from a hot region of either the fuser roll or the pressure roll using a working fluid, dissipating the absorbed heat by evaporating the working fluid such that a temperature along a length of the at least one of the fuser roll and the pressure roll becomes substantially uniform.

Some advantages of various exemplary systems and methods may include (i) having heat from high temperature regions outside the paper path flow to lower temperature regions, which will heat up the back of the paper, thereby assisting fusing, and (ii) the high temperature regions outside the paper path will cool down and a substantially uniform temperature profile along the fuser and pressure rolls may be achieved.

These and other features and advantages are described in, or are apparent from, the following detailed description of various exemplary embodiments of the systems and methods.

BRIEF DESCRIPTION OF THE DRAWINGS

Various exemplary embodiments of systems and methods will be described in detail, with reference to the following figures, wherein.

DETAILED DESCRIPTION OF EMBODIMENTS

Figure 3:
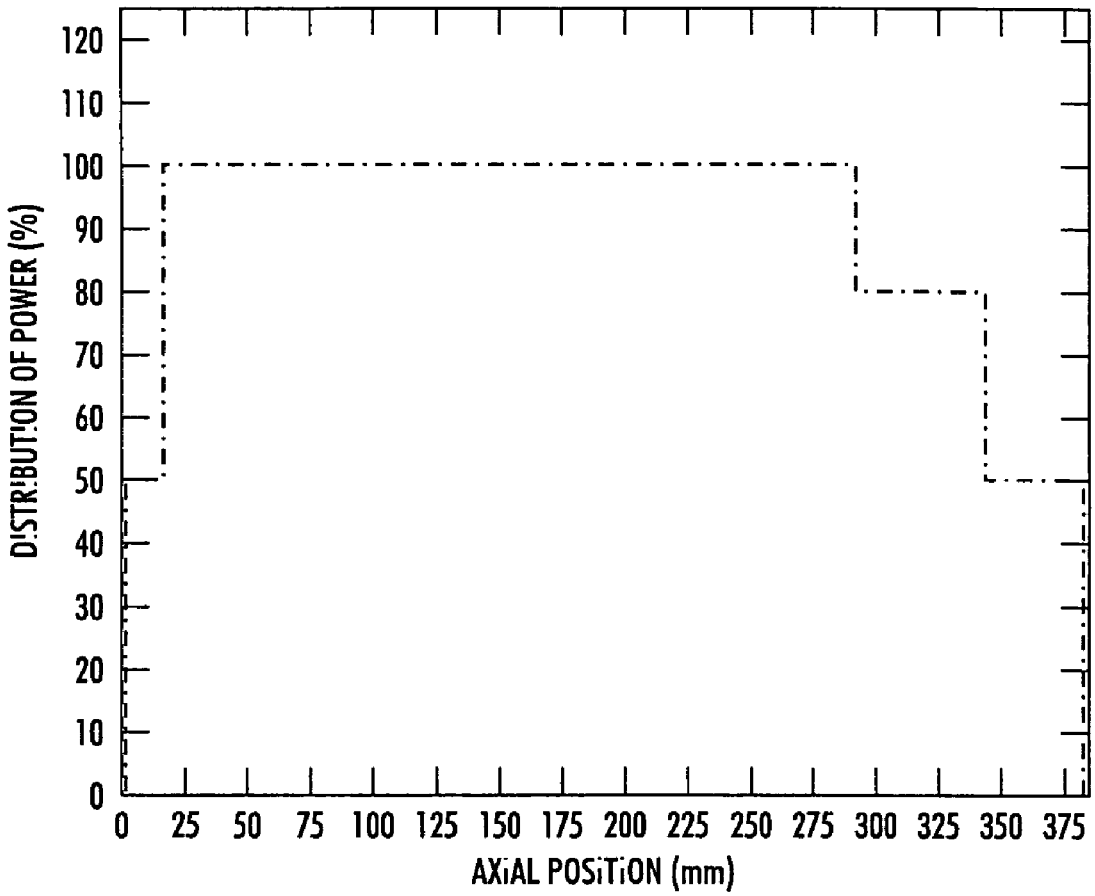
FIG. 3 is a diagram illustrating an axial power distribution profile in an exemplary one-lamp heating scheme with a heat pipe.

FIG. 3 is a diagram illustrating an axial power distribution profile in an exemplary one-lamp heating scheme with a heat pipe. To make a temperature more uniform across a length of the fuser roll, a heat pipe may be applied in contact with a pressure roll to redistribute heat from hotter regions to colder regions along a length of the pressure roll. In such a configuration, only one heating lamp may be used to heat the fuser roll because the heat pipe will generally compensate for axial temperature non-uniformity.

Figure 1:
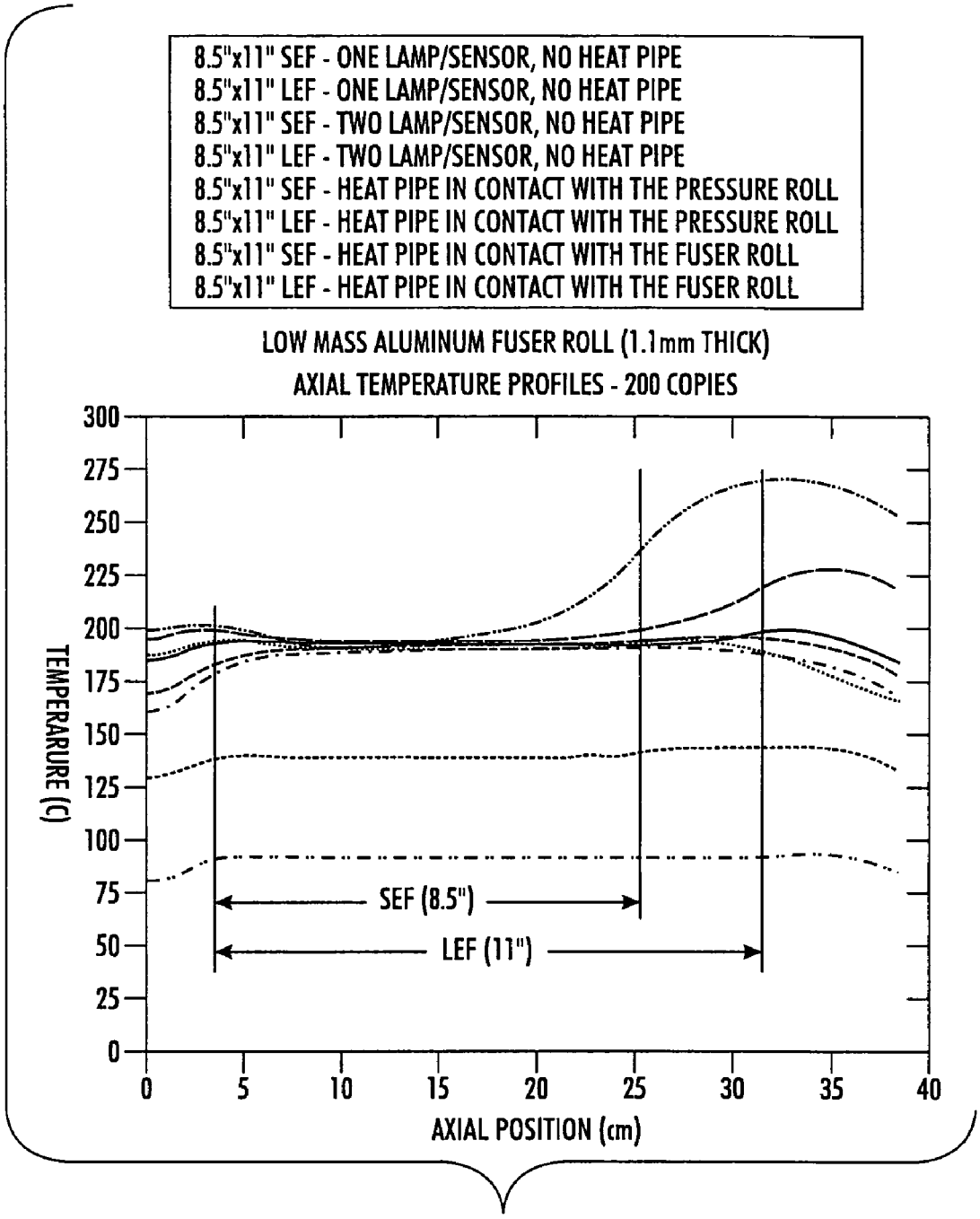
FIG. 1 is a diagram illustrating axial temperature profiles in a low mass instant-on fuser roll system.
Figure 2:
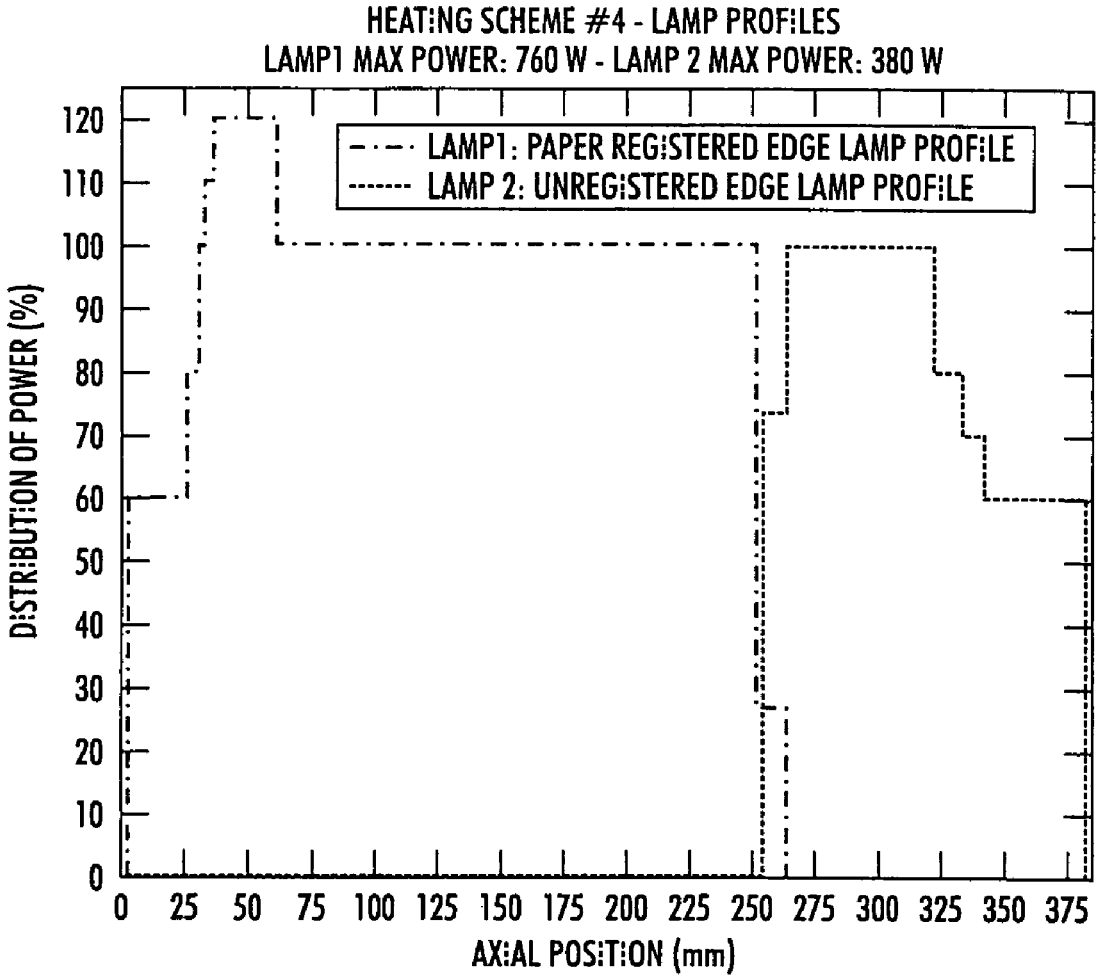
FIG. 2 is a diagram illustrating axial power distribution profiles in a two-lamp heating scheme.
Figure 4:
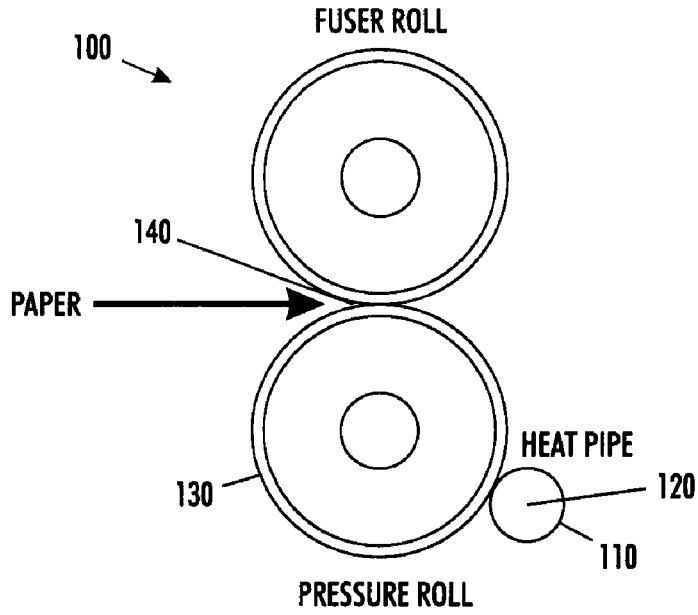
FIG. 4 is a diagram illustrating an exemplary energy transfer device.

FIG. 4 is a diagram illustrating an exemplary energy transfer device 100. In FIG. 4, a heat pipe 110 engages a pressure roll 130 past a fusing nip 140. According to various exemplary embodiments, the heat pipe 110 is in contact with the pressure roll 130 along a substantial length of the heat pipe 110 such as, for example, more than half the length of the heat pipe 110. The heat pipe 110 may also be cylindrical, hollow and open at least on one end, and the heat pipe 110 may also be solid or a closed hollow cylinder with closed ends. A heat transferring fluid may also be encapsulated within the heat pipe 110 with or without a wicking medium. According to various exemplary embodiments, the heat pipe 110 is in contact with the pressure roll 130 along a substantial length of the pressure roll 130 such as, for example, more than half the length of the pressure roll 130. The heat pipe 110 may comprise, for example, a heat conductive hollow cylinder such as, for example, copper or other metal or alloy thereof, or a conductive non-metal such as a carbon based compounds, for example, carbon fiber, nanotubes or composites. The hollow cylinder may enclose a working fluid 120 such as, for example, water, in a two-phase mixture, liquid and vapor. The heat pipe 110 engaging the pressure roll 130 past the fusing nip 140 may have the effect of rendering a substantially uniform axial temperature profile along the pressure roll 130. Substantial uniformity of the axial temperature profile is shown, for example, in the temperature profile illustrated in FIG. 1 by the curves labeled "Heat Pipe in contact with the Fuser Roll," and "Heat Pipe in contact with the Pressure Roll." According to various exemplary embodiments, the contact width between the heat pipe 110 and the pressure roll 130 is about 0.001 mm to 4.0 mm.

Figure 5:
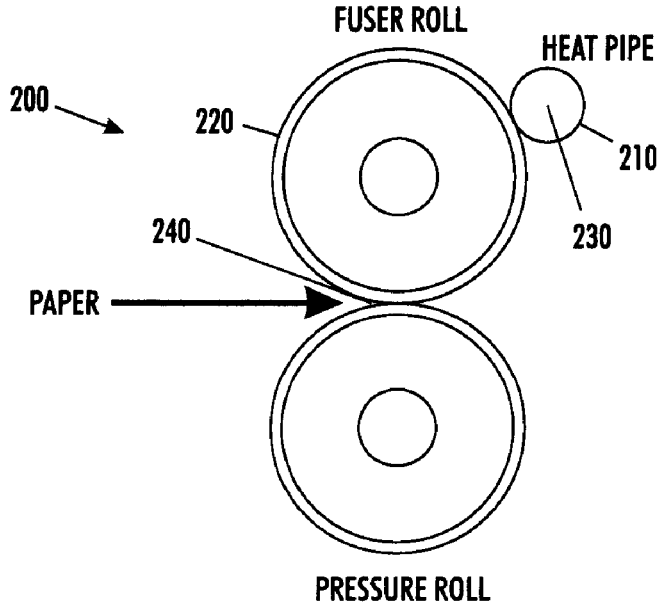
FIG. 5 is a diagram illustrating another exemplary energy transfer device.

FIG. 5 is a diagram illustrating another exemplary energy transfer device 200. In FIG. 5, a heat pipe 210 engages a fuser roll 220 past a fusing nip 240. According to various exemplary embodiments, the heat pipe 210 is in contact with the fuser roll 220 along a substantial length of the heat pipe 210 such as, for example, more than half the length of the heat pipe 210. According to various exemplary embodiments, the heat pipe 210 is in contact with the fuser roll 220 along a substantial length of the fuser roll 220 such as, for example, more than half the length of the fuser roll 220. The heat pipe 210 may comprise, for example, a heat conductive hollow cylinder such as, for example, copper or other metal or alloy thereof, or a conductive non-metal such as a carbon based compounds, for example, carbon fiber, nanotubes or composites. The hollow cylinder may enclose a working fluid 230 such as, for example, water, in a two-phase mixture, liquid and vapor. The heat pipe 210 engaged to the fuser roll 220 may have the same effect in rendering a substantially uniform axial temperature profile as illustrated, for example, in FIG. 1. According to various exemplary embodiments, the contact width between the heat pipe 210 and the fuser roll 220 is about 0.001 mm to 4.0 mm.

However, because of the heat pipe mass that is added to the fuser roll when the heat pipe is in contact with the fuser roll, as shown in FIG. 5, although temperature uniformity is increased, the warm-up time or the heat input may also be increased. Instead, when the heat pipe is in contact with the pressure roll, as shown in FIG. 4, warm-up time and heat input is generally not increased because the fuser roll and the pressure roll are not engaged during warm-up or during any other static condition. Therefore for a low mass, "instant-on" or rapid warm-up fusing system, a heat pipe in contact with the pressure roll may be more effective than a heat pipe in contact with the fuser roll. Moreover, a heat pipe in contact with a soft elastomeric coated pressure roll may be more effective because the soft pressure roll allows a larger surface contact with the heat pipe, and thus allows a more efficient energy transfer between the heat pipe and the pressure roll.

Figure 6:
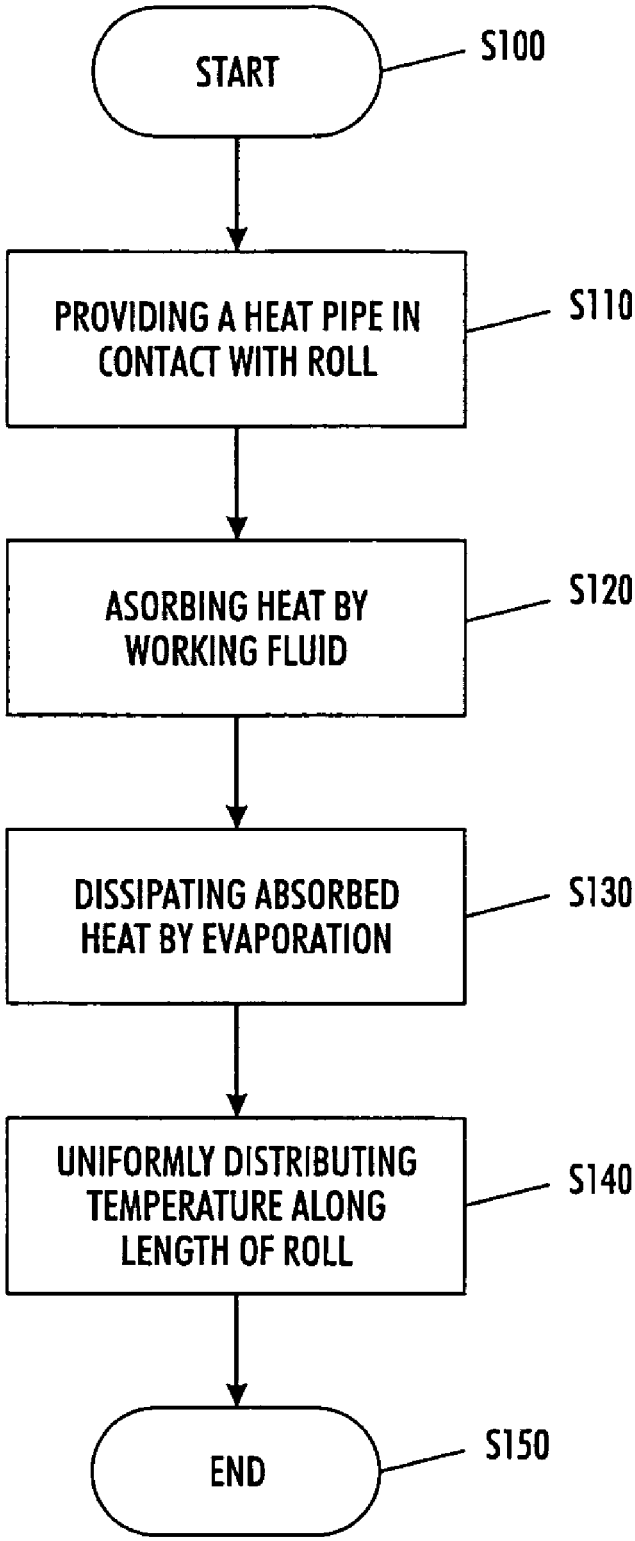
FIG. 6 is a flow chart illustrating an exemplary method of using an energy transfer device.

FIG. 6 is a flow chart illustrating an exemplary method of using an energy transfer device in a marking device. The method starts in step S100, and continues to step S110, in which a heat pipe may be provided in contact with the pressure roll that is part of a marking system. Alternatively, the heat pipe may be provided in contact with the fuser roll of the marking device. According to various exemplary implementations, the heat pipe may be a hollow cylinder that encloses a working fluid such as, for example, water, or any other fluid. Next, control continues to step S120, in which heat resulting from marking operations and emanating from the pressure roll and/or the fuser roll may be transferred through the heat pipe and may be absorbed by the working fluid. Regions of the pressure roll outside a paper path of the marking device may be at a relatively high temperature because such regions come in contact with the hot regions of the fuser roll. As such, when the heat pipe engages the pressure roll in the regions outside the paper path, the working fluid inside the heat pipe may absorb heat from the hot regions of the pressure roll, thereby cooling down the hot regions of the pressure roll.

Next, control continues to step S130, in which the heat absorbed by the working fluid may be dissipated via evaporation of the working fluid. The vapor may then flow from the relatively hot regions of the heat pipe, heated by the pressure roll, to relatively cold regions of the heat pipe and may condense on the cooler regions, thus giving up latent heat to the cooler regions of the heat pipe and to corresponding cooler regions of the pressure roll. Accordingly, the working fluid present inside the heat pipe may be in two phases, liquid and vapor.

Next, control continues to step S140, in which, as a result of the evaporation of the working fluid and the dissipation of the heat, the temperature across the heat pipe, and consequently across the pressure roll (or the fuser roll), may become substantially uniform. A uniform temperature profile on the pressure roll may thus be produced and maintained, for example, to achieve a substantially uniform profile across the length of the fuser roll, as shown in the dotted curves of FIG. 1 as heat is transferred from relatively hotter portions of the system to the relatively cooler portions. Furthermore, as heat is transferred from the hot regions of the pressure roll, which are outside the paper path, to the cool regions of the pressure roll, which are inside the paper path, the back side of paper or other medium that is in contact with the pressure roll may be heated, thereby assisting fusing. Next, control continues to step S150, in which the method ends.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. An energy transfer device, comprising: a fuser roll; a pressure roll, the pressure roll and the fuser roll being part of a marking system; and a heat pipe, the heat pipe being in contact with at least one of the fuser roll and the pressure roll, wherein the heat pipe is a solid cylinder.

2. The energy transfer device of claim 1, wherein the heat pipe is in contact with at least one of the fuser roll and the pressure roll along a substantial length of the heat pipe.

3. The energy transfer device of claim 1, wherein the pressure roll comprises an elastomer coated roll.

4. The energy transfer device of claim 1, wherein the heat pipe is configured to transfer heat from a relatively hot region of the pressure roll to a relatively cold region of the pressure roll.

5. The energy transfer device of claim 1, wherein the heat pipe is configured to transfer heat from a relatively hot region of the fuser roll to a relatively cold region of the fuser roll.

6. The energy transfer device of claim 1, wherein the heat pipe is configured to transfer heat along a substantial length of the pressure roll.

7. The energy transfer device of claim 1, wherein the heat pipe is configured to transfer heat along a substantial length of the fuser roll.

8. The energy transfer device of claim 1, wherein the fuser roll comprises a low mass fuser roll.

9. The energy transfer device of claim 1, further comprising a single heating lamp arranged to heat the fuser roll.

10. A xerographic device comprising the energy transfer device of claim 1.

11. A method of using an energy transfer device that comprises a fuser roll, a pressure roll, the pressure roll and the fuser roll being part of a marking system, and a heat pipe, the method comprising: contacting the heat pipe with at least one of the fuser roll and the pressure roll; absorbing heat from a relatively hot region of the at least one of the fuser roll and the pressure roll, wherein the heat pipe is a solid cylinder.

12. The method of claim 11, further comprising: maintaining a substantially uniform temperature along a substantial length of the at least one of the fuser roll and the pressure roll.

13. An energy transfer device, comprising: a fuser roll; a pressure roll, the pressure roll and the fuser roll being part of a marking system; and a heat pipe, the heat pipe being in contact with an outer surface of at least one of the fuser roll and the pressure roll, wherein a contact width between the heat pipe and the at least one of the fuser roll and the pressure roll is between about 0.001 mm to about 4.0 mm.

14. The energy transfer device of claim 13, wherein the heat pipe comprises a heat conductive hollow cylinder that encloses a working fluid in a two-phase mixture.

15. The energy transfer device of claim 14, wherein the heat pipe comprises at least one of a high thermal conductive metal and a carbon-based compound, and wherein the working fluid comprises water in a liquid-vapor mixture.

* * * * *